US010519015B2

(12) United States Patent
Chung

(10) Patent No.: US 10,519,015 B2
(45) Date of Patent: Dec. 31, 2019

(54) COMPOSITE BOTTLE OPENER

(71) Applicant: Jingle Master International Limited, Tortola (VG)

(72) Inventor: Yeh-Yi Chung, Tortola (VG)

(73) Assignee: JINGLE MASTER INTERNATIONAL LIMITED, Tortola (VG)

( * ) Notice: Subject to any disclaimer, the term of this patent is extended or adjusted under 35 U.S.C. 154(b) by 177 days.

(21) Appl. No.: 15/862,575

(22) Filed: Jan. 4, 2018

(65) Prior Publication Data

US 2018/0194605 A1 Jul. 12, 2018

(30) Foreign Application Priority Data

Jan. 6, 2017 (CN) ..... 2017 2 0014608 U

(51) Int. Cl.
*B67B 7/04* (2006.01)

(52) U.S. Cl.
CPC .... *B67B 7/0441* (2013.01); *B67B 2007/0458* (2013.01)

(58) Field of Classification Search
CPC ..... B67B 7/0441; B67B 2007/0458
See application file for complete search history.

(56) References Cited

U.S. PATENT DOCUMENTS 6,196,086 B1 * 3/2001 Gort-Barten ..... B67B 7/0441 30/1.5
6,739,215 B2 * 5/2004 Lozeau ..... B67B 7/0447 7/155
6,978,696 B2 * 12/2005 Yu ..... B67B 7/0441 81/3.29
7,318,362 B1 * 1/2008 Hoyer ..... B67B 7/0447 7/155
2003/0217621 A1 * 11/2003 Su ..... B67B 7/08 81/3.09
2018/0327241 A1 * 11/2018 Brouillac ..... B67B 7/0441

* cited by examiner

*Primary Examiner* — David B. Thomas
(74) *Attorney, Agent, or Firm* — Juan Carlos A. Marquez; Marquez IP Law Office, PLLC

(57) ABSTRACT

A composite bottle opener includes: a cork remover unit having a hand grip, a bottle stopper and a corkscrew, one end of which is connected to the hand grip while the hand grip is attached detachably on the bottle stopper; a retractable fixing sleeve including an upper sleeve mounted movably on a lower sleeve while the cork removes unit is mounted on the upper sleeve; and one compressible cutter unit installed on a side wall of the lower sleeve such that the cutter is movable in a thickness direction of the side wall of the lower sleeve. In use, one needs to apply a little torque to tear away the sealing foil around the outer periphery of the bottle as well as the cork blocking the mouth of the bottle. The bottle stopper can be plugged back into the mouth of the bottle after the cork removal.

10 Claims, 7 Drawing Sheets

COMPOSITE BOTTLE OPENER

CROSS-REFERENCE TO RELATED APPLICATION

This application claims the priority of Chinese patent application No. 201720014608.9, filed on Jan. 6, 2017, which is incorporated herewith by reference.

BACKGROUND OF THE INVENTION

1. Field of the Invention

The present invention relates generally to a bottle opener, and more particularly to a composite bottle opener.

2. The Prior Arts

A hand-held bottle opener has been invented due to prevalence and popularity of wine drinking for removing the cork off a wine bottle. The bottle opener available presently in the market consists of two types: a T-shaped bottle opener and a fulcrum-type bottle opener.

The T-shaped bottle opener includes a T-shaped handle and a spiral corkscrew connected to an end of the T-shaped handle such that the spiral corkscrew extends through the cork of a wine bottle upon twisting of the T-shaped handle relative to the wine bottle and after which when the T-shaped handle is pulled forcibly away from the wine bottle, the spiral corkscrew together with the cork is removed from the wine bottle. This type of bottle opener is simple in structure, low in cost, but requires manual labor when using the same. For those people with little strength, it is inconvenient to remove the cork off the wine bottle. In fact, it is noted that some skill is required to use this type of T-shaped bottle opener or else may result in damage or broken of the wine bottle and/or causing danger to the user during removal of the cork off the wine bottle.

In addition, the fulcrum-type bottle opener is designed to minimize lesser applied torque compared to the former one, but in actual application, must use his both hands simultaneously to lift the upwardly oriented fulcrum toward an exterior of the wine bottle, only then the cork con be removed entirely off the wine bottle. Pressing and/or lifting the fulcrum, toward an exterior of the wine bottle is not easy to conduct and in the event that the operator is unable to hold the wine bottle and the fulcrum type bottle opener simultaneously and/or when the applied torque is not distributed uniformly on the wine bottle, the wine bottle may turn upside down and the wine may spill out from the wine bottle, thereby causing inconvenience to use this type of bottle opener.

Moreover, in most of the wine bottles we consume today, the mouth of the wine bottle is plugged and sealed with the cork, some additional sealing means, like sealing foils or film papers are sheathed over the external surface of the mouth of the wine bottle, thereby doubly sealing the wine bottle in order to preserve the taste of the wine. To consume the wine, the sealing foil encapsulating an exterior of the mouth of the wine bottle needs be removed prior to twisting the corkscrew through the cork for removing the cork off the wine bottle. A cutter is generally used to remove the sealing foil (together with the cork) first. However, the above-stated bottle openers are simple in structures and hence require additional cutting tool to remove the sealing foils prior to removing the cork off the wine bottle. Hence, if the operator is left in a state, where he cannot find a cutter, he is unable to remove the sealing kid as well as the cork, thereby inconveniencing the consumer of the wine bottle.

After removal of the cork off the wine bottle, the wine should be consumed within a predetermined time and in the event he or she cannot consume and/or enjoy the wine within that period of time, the cork should be plugged back into the mouth of the wine bottle or other means or substance should be used to seal and block the mouth of the wine bottle. It is noted that the cork chips or dust may fall into the wine bottle during the plugging of the cork back into the mouth of the wine bottle, thereby contaminating the remaining wine in the bottle. To locate other means or substance for sealing and blocking the mouth of the wine bottle is also inconvenient for the wine consumer.

Therefore, after observing the above-stated disadvantages, the inventor of the present application feels that an improvement should be searched out in order to eliminate these disadvantages.

SUMMARY OF THE INVENTION

A primary objective of the present invention is to provide a composite bottle opener, which is capable of removing the sealing foil or paper encapsulating around the neck of a wine bottle and the cork off the mouth of the wine bottle without rotating the wine bottle and in which a little torque is applied, thereby achieving the easy and smooth operation effort.

A secondary objective of the present invention is to provide a composite bottle opener, which includes an independent bottle stopper such that after removal of the cork off the wine bottle, the bottle stopper can be plugged back into the mouth of the wine bottle so as to prevent the wine from spilling outward from the wine bottle, simultaneously preventing waste and impurities from getting interior of the wine bottle in order to preserve the taste of the wine.

Another objective of the present invention is to provide a composite bottle opener, which includes a plurality of compressible cutter units such that when it is desired to remove the sealing papers or foil off the wine bottle, rotation of the composite bottle opener relative to the wine bottle results in tearing away of the sealing foil off the wine bottle. The operation performance is easy and convenient due to installation of the compressible cutter units, the service life of cutting tools of the compressible cutter units can be prolonged.

Yet another objective of the present invention is to provide a composite bottle opener, which includes a plurality of compressible cutter units that have rotatable cutting tools with symmetric shearing edges extending outwardly and radially so as to permit swift rotation of the composite bottle opener relative to the wine bottle during removal the sealing papers or foil, results in tearing away the sealing foil off the wine bottle. Since the rotatable cutting tools are designed to have symmetric shearing edges, removal of the sealing foil off the wine bottle can be achieved quickly.

In order to achieve the preceding objectives, a composite bottle opener of the present invention includes: a cork remover unit having a hand grip, a bottle stopper and a corkscrew, wherein one end of the corkscrew is connected to the hand grip while the hand grip is attached detachably on the bottle stopper; a retractable fixing sleeve including a lower sleeve and an upper sleeve mounted movably on the lower sleeve while the cork remover unit is mounted on the upper sleeve, and at least one compressible cutter unit installed on a side wall of the lower sleeve in such a manner that the compressible cutter unit is movable in a thickness direction of the side wall of the lower sleeve.

Preferably, the hand grip and the upper sleeve are integrally formed relative to each other. The hand grip has an upper side dented in such a manner to form a channel while the bottle stopper has a lower portion formed with a plurality of annular engaging ribs for securely engaging a side wall confining the channel in the hand grip.

Preferably, the lower sleeve has a connection portion extending into the upper sleeve and a restriction portion for sleeving over an outer periphery of a top end of a bottle, which is to be opened by the composite bottle opener of the present invention.

In one embodiment of the present invention, each of the upper and lower sleeves is tubular shape such that the connection portion of the lower sleeve has an inner diameter smaller than that of the restriction portion of the lower sleeve, thereby forming a shoulder between the connection portion and the restriction portion. The shoulder is used for abutting against a top end of a bottle, once the composite bottle opener is disposed on the top end of the bottle.

Preferably, the lower sleeve has a peripheral wall formed with a pair of symmetric mounting holes, in which two of the compressible cutter units are installed such that the compressible cutter units are disposed on an inner side wall of the restriction portion in a symmetric manner.

Preferably, each of the compressible cutter units includes a cantilever button and a cutting tool, wherein an inner side wall of the restriction portion is formed with a pair of mounting holes for receiving the cantilever buttons respectively while the cutting tools project radially and outwardly from the inner side wall of the restriction portion.

In one embodiment of the present invention, each of the cantilever buttons has a tool-reception slot for receiving rotatably a respective one of the cutting tools therein. Each of the cutting tools includes a tool body having an outer peripheral portion formed with a pair of symmetric shearing edges.

Preferably, the bottle stopper is formed independently from the hand grip and is adapted to be plugged into a mouth of a bottle while the plurality of annular engaging ribs of the bottle stopper are adapted to engage securely an inner side wall confining the mouth of the bottle.

In one embodiment of the present invention, the upper sleeve has a peripheral wall formed with a through hole in spatial communication with an interior space thereof while the lower sleeve is fabricated from transparent materials.

Preferably, the connection portion of the lower sleeve has an inner side wall formed with a plurality of angularly spaced and axially extending engaging ribs.

Some distinct features of the present invention reside in that since the cork remover unit is mounted on the retractable fixing sleeve and by implementing the compressible cutter unit on a side wall of the lower sleeve in such a manner that when in use the compressible cutter unit is movable in a thickness direction of the side wall of the lower sleeve upon rotation of the lower sleeve relative to the bottle so as to tear away the sealing foil off the wine bottle in addition to removing the cork off the wine bottle without rotating the latter, thereby minimizing the applied torque. In addition, due to the bottle stopper is independently formed from the hand grip, the bottle stopper can be plugged back to block the mouth of the wine bottle after removal of the cork off the wine bottle, thereby preventing waste and impurities from getting interior of the wine bottle and hence preserving the taste of the wine.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
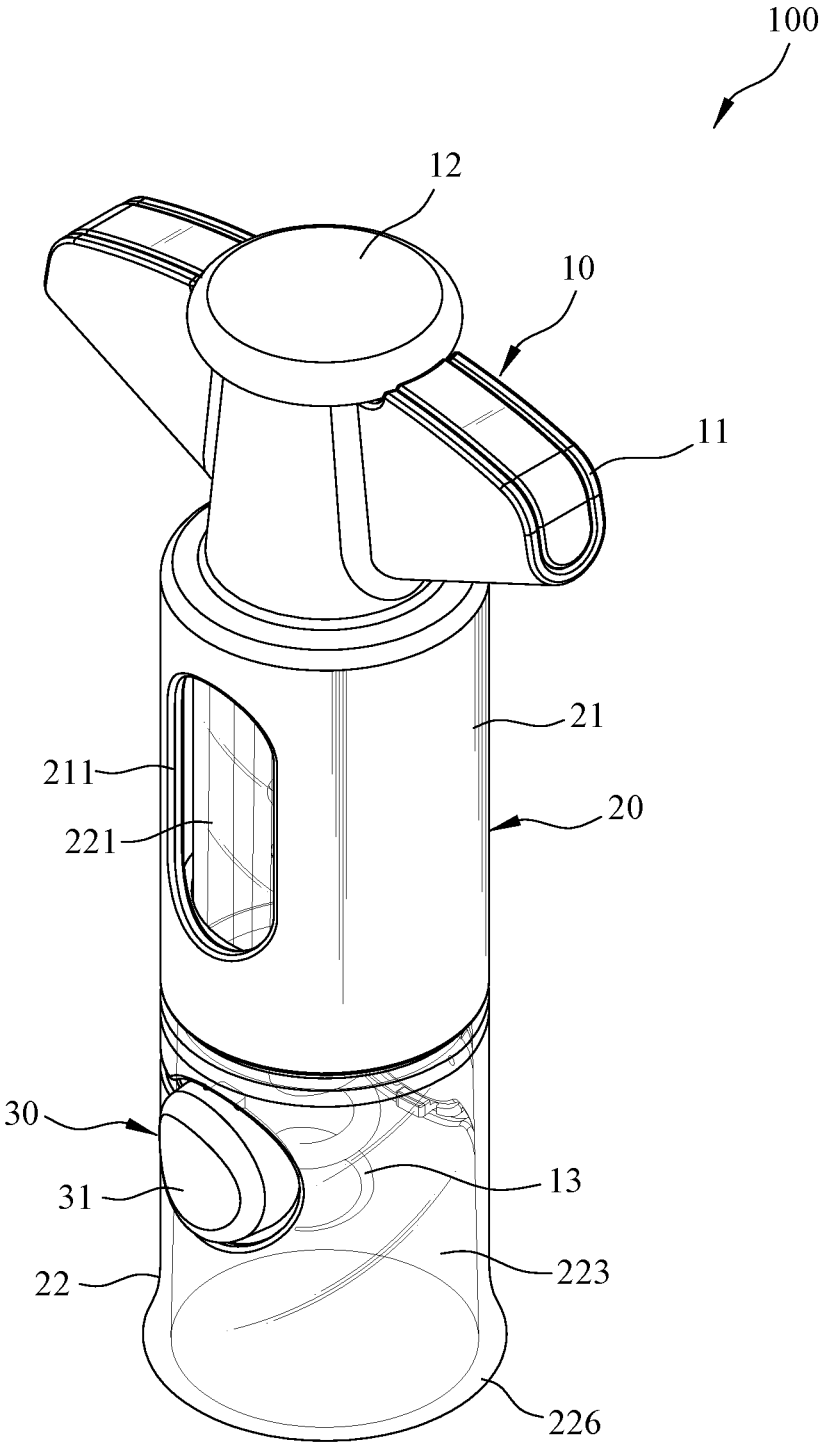
FIG. 1 is a perspective view of a composite bottle opener of the present invention.
Figure 2:
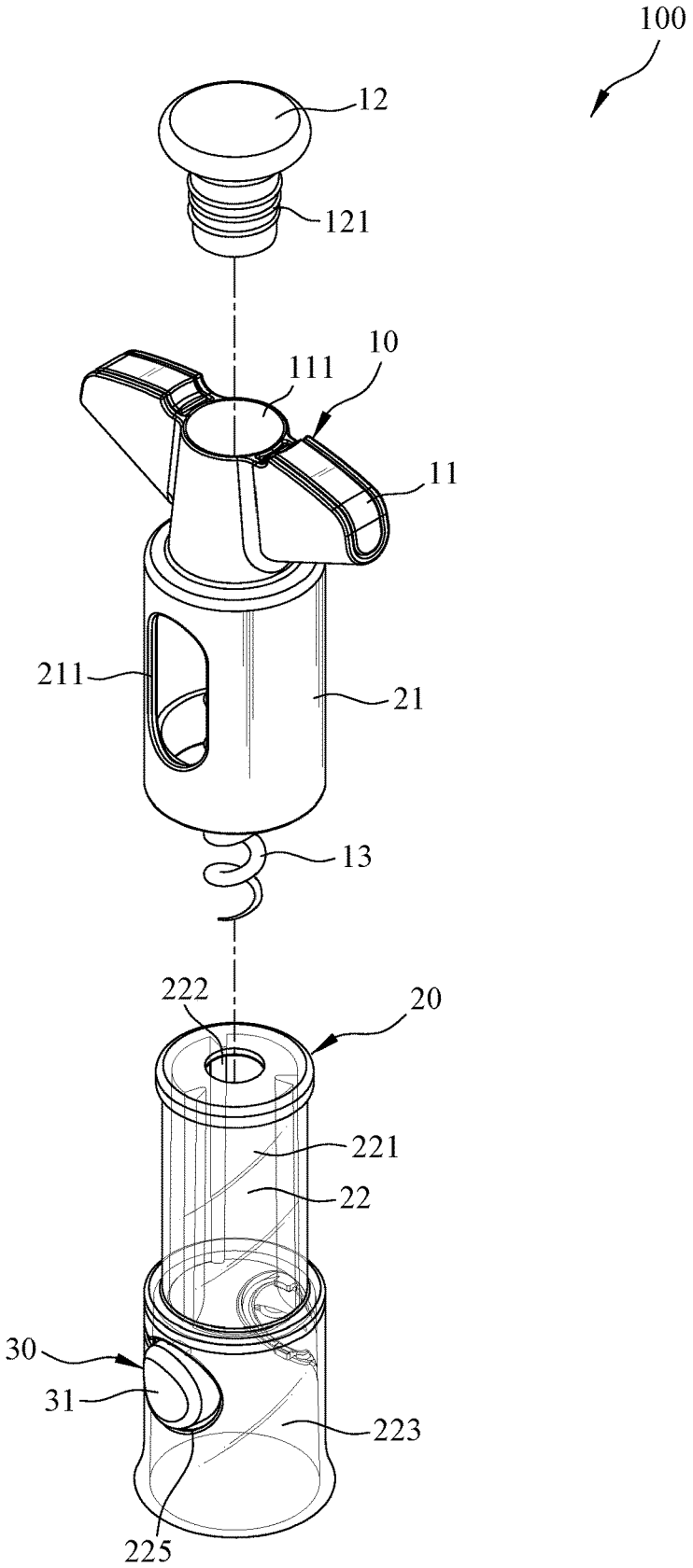
FIG. 2 is a perspective and exploded view of the composite bottle opener of the present invention.
Figure 3:
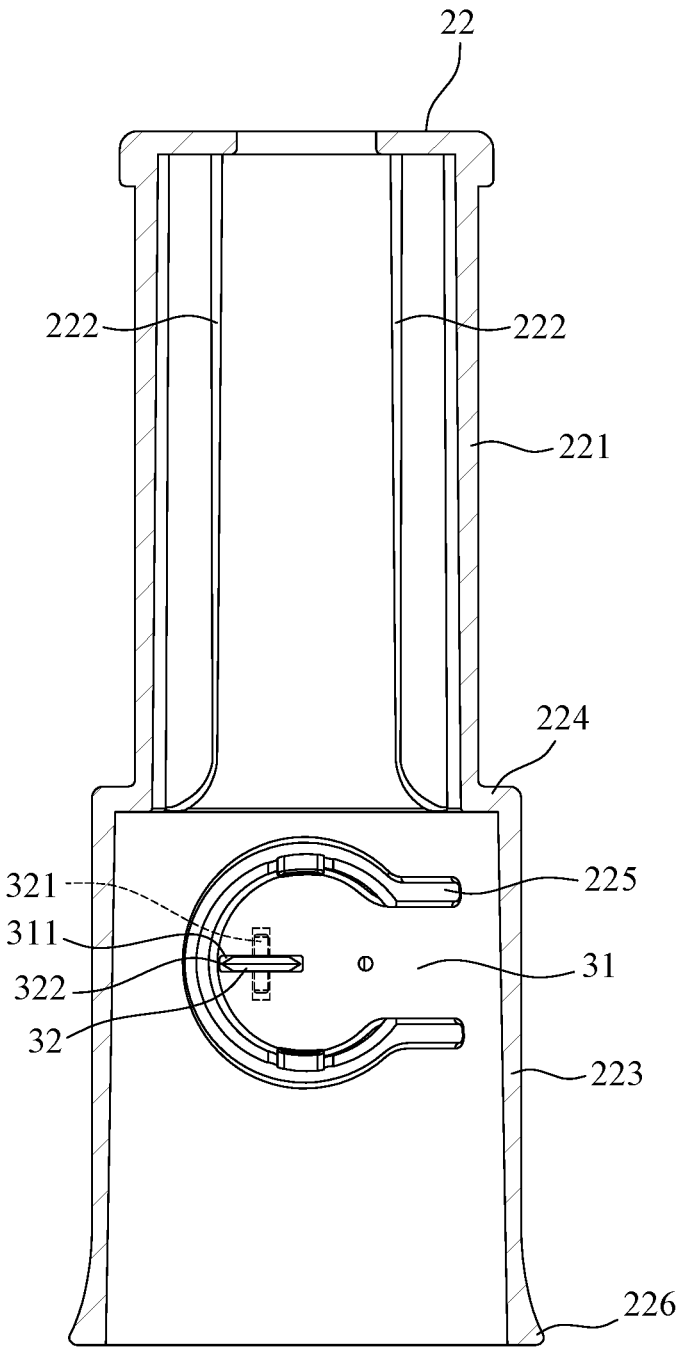
FIG. 3 is a cross sectional of a lower sleeve of a retractable fixing sleeve employed in the composite bottle opener of the present invention.

Referring to FIGS. 1-3, wherein FIG. 1 is a perspective view of a composite bottle opener of the present invention; FIG. 2 is a perspective and exploded view of the composite bottle opener of the present invention; and FIG. 3 is a cross sectional of a lower sleeve of a retractable fixing sleeve employed in the composite bottle opener of the present invention. As shown, the composite bottle opener 100 of the present invention includes: a cork remover unit 10, a retractable fixing sleeve 20 and two compressible cutter units 30.

The cork remover unit 10 includes a hand grip 11, a bottle stopper 12 and a corkscrew 13, wherein one end of the corkscrew 13 is connected to the hand grip 11 while the hand grip 11 is attached detachably to the bottle stopper 12. In this embodiment, the hand grip 11 has an upper side dented in such a manner to form a wine channel 111 while the bottle stopper 12 has a lower portion formed with a plurality of axially spaced annular engaging ribs 121 for securely engaging a side wall confining the wine channel 111 in the hand grip 11. Preferably, the bottle stopper 12 is formed independently from the hand grip 11 such that it can be used for blocking the mouth of a bottle 200 (see FIG. 7).

The retractable fixing sleeve 20 includes an upper sleeve 21 and a lower sleeve 22, wherein the upper sleeve 21 is mounted movably on the lower sleeve 22 while the cork remover unit 10 is mounted on the upper sleeve 21. In one embodiment of the present invention, the hand grip 11 can be integrally formed with the upper sleeve 21. The lower sleeve 22 has a connection portion 221 extending into the upper sleeve 21 and a restriction portion 223 for sleeving over an outer periphery of a top end of a bottle 200 (see FIG. 4), which is to be opened by the composite bottle opener of the present invention. Referring to FIGS. 2 and 3, each of the upper and lower sleeves 21, 22 is tubular shape while the connection portion 221 of the lower sleeve 22 has an inner side wall formed with a plurality of angularly spaced axially extending engaging ribs 222 for confining the cork 201 in the bottle 200. In this embodiment, the connection portion 221 of the lower sleeve 22 has an inner diameter smaller than that of the restriction portion 222 of the lower sleeve 22, thereby defining a shoulder 224 between the connection portion 221 and the restriction portion 223 for abutting against a top end of a bottle 200 (see FIG. 6), once the composite bottle opener 100 is disposed on the top end of the bottle 200.

Referring to FIGS. 1 and 2, the hand grip 11 is integrally formed with the upper sleeve 21. The upper sleeve 21 has a peripheral wall formed with a through hole 211 in spatial communication with an interior space thereof while the lower sleeve 22 is fabricated from transparent materials. During the cork removing process, the user of the composite bottle opener of the present invention can peep through the through hole 211 of the upper sleeve 21 to examine how far the corkscrew 13 has penetrated through the cork 201 in order to ensure that the cork 201 will be fully pulled out together with the corkscrew 13 once the latter is pulled away from the wine bottle 200 (see FIG. 5). In other words, the user can adjust by peeping through the hole 211 in the upper sleeve 21, how much force should be applied to pull out the cork 201 off the wine bottle 200.

The compressible cutter units 30 are installed on the lower sleeve 22. To be more specific, the lower sleeve 22 has a peripheral wall formed with a pair of symmetric holes 211, in which two of the compressible cutter units 30 are installed such that the compressible cutter units 30 are disposed on the restriction portion 223 of the lower sleeve 22 in a symmetric manner, more particularly the compressible cutter units 30 are disposed on the restriction portion 223 of the lower sleeve 22 in a symmetric manner such that the compressible cutter units 30 are movable in a thickness direction of the side wall of the lower sleeve 22. In this embodiment, each of the compressible cutter units 30 includes a cantilever button 31 fabricated from flexible materials and a cutting tool 32. The inner side wall of the restriction portion 223 of the lower sleeve 22 is formed with a pair of mounting holes 225 for receiving the cantilever buttons 31 respectively while the cutting tools 32 project radially and outwardly from the inner side wall of the restriction portion 223.

Referring to FIG. 3, each of the cantilever buttons 31 has a tool-reception slot 311 for rotatably receiving a respective one of the cutting tools 32 therein. Each of the cutting tools 32 includes a tool body 321 having an outer peripheral portion formed with a pair of symmetric shearing edges 322.

In order to understand the distinct features provided by the composite bottle opener 100 of the present invention, the following paragraphs describe the detailed application.

Figure 4:
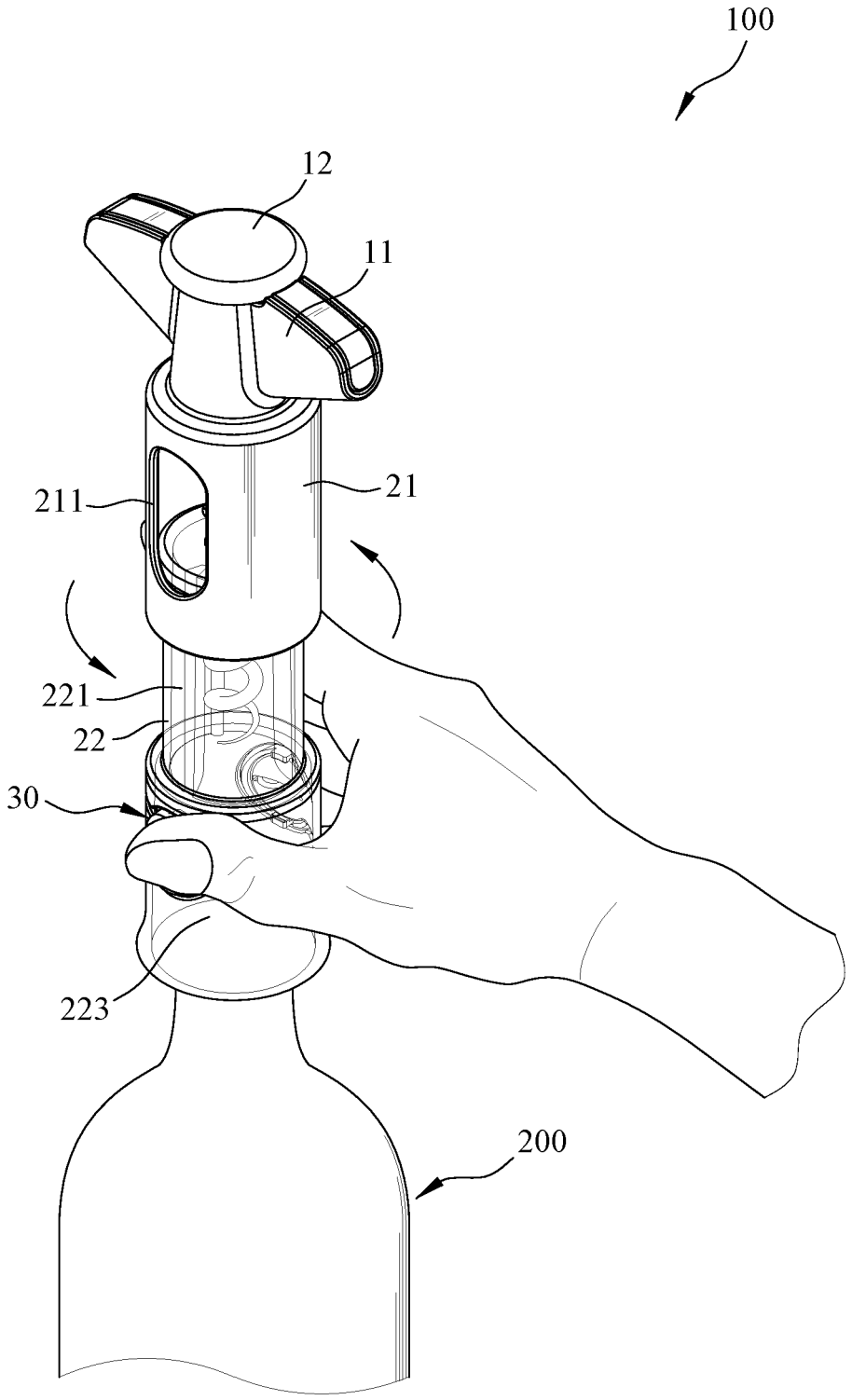
FIG. 4 illustrates the composite bottle opener of the present invention in application.
Figure 5:
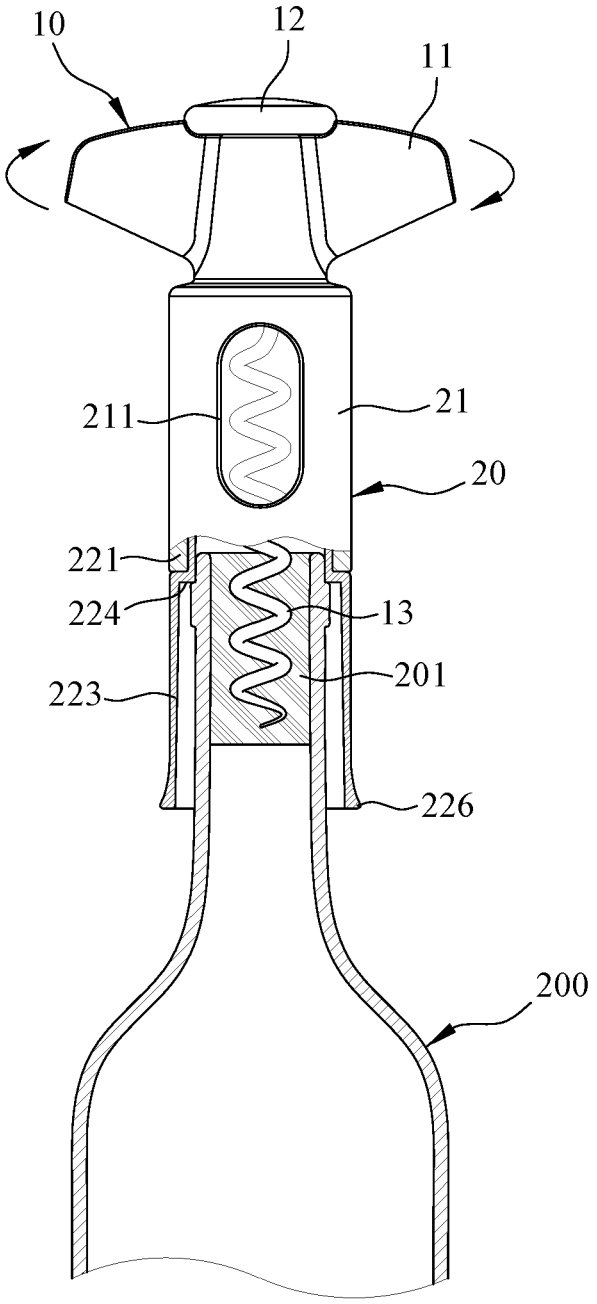
FIG. 5 illustrates the composite bottle opener of the present invention in application, in which a portion of a wine bottle being opened is shown in cross sectional view.
Figure 6:
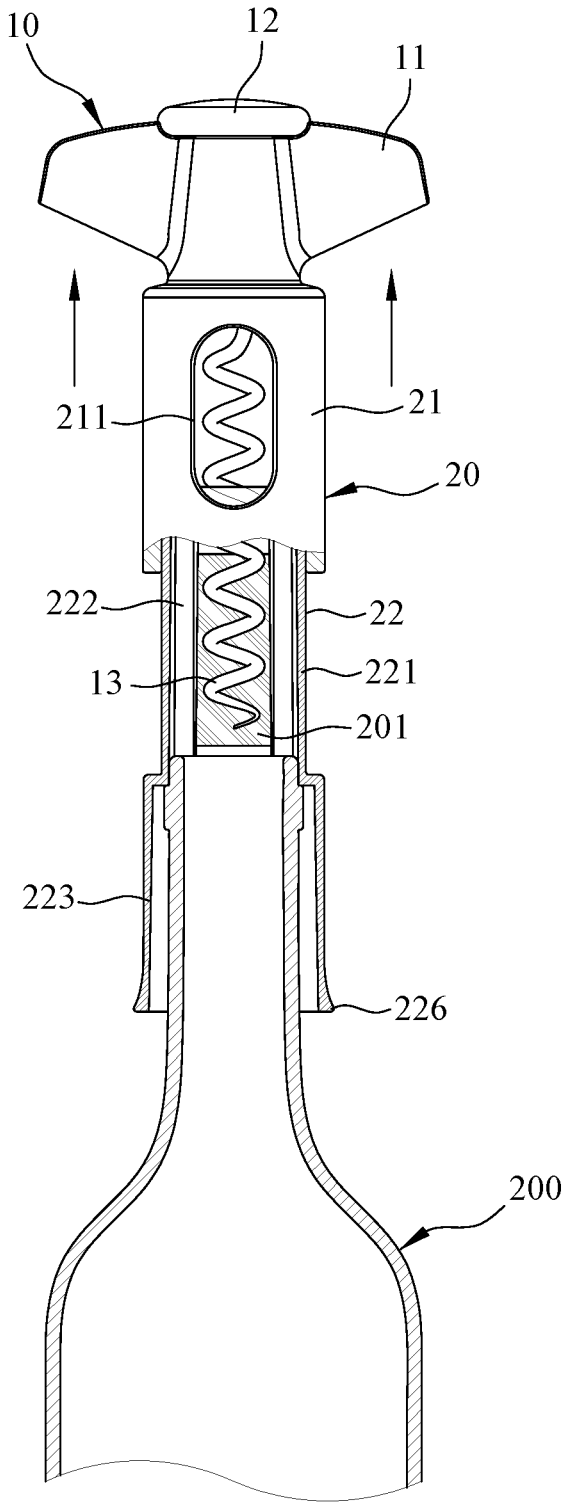
FIG. 6 is a fragmentary cross-sectional view of the composite bottle opener of the present invention in application, illustrating how a cork of a wine bottle is removed off the wine bottle.

Referring to FIGS. 4, 5 and 6, wherein FIG. 4 illustrates the composite bottle opener of the present invention in application; FIG. 5 illustrates the composite bottle opener of the present invention in application. In which a portion of a wine bottle being opened is shown in cross sectional view; and FIG. 6 is a fragmentary cross-sectional of the composite bottle opener of the present invention in application, illustrating how a cork of a wine bottle is removed off the wine bottle. To remove the cork 201 off the wine bottle 200, the composite bottle opener 100 of the present invention is first of all sleeved around an outer peripheral portion of the top end of the wine bottle as best shown in FIG. 5, where the shoulder 224 of the lower sleeve 22 abuts against the top end of the wine bottle 200. At this time, the compressible cutter units 30 located at two symmetric sides of the inner wall of the lower sleeve 22 are spaced apart from the sealing foil encapsulating the outer peripheral portion of the top end of the wine bottle 200. After holding the composite bottle opener of the present invention with one hand, the user can press the cutter units 30 inwardly and radially relative to the wine bottle 200 by simultaneously rotating the composite bottle opener 100 a half circle reciprocally relative the wine bottle 200 (see FIG. 4), tearing away the sealing foil off the neck of the wine bottle 20. Then, the hand grip 11 is pressed downward relative to the wine bottle 200 and is further twisted in the clockwise direction, which action causes penetration of the corkscrew 13 through the cork 201 while the axial engaging ribs 222 extend between the top end of the wine bottle and the cork 201 to confine the latter thereamong. Continuous twisting of the hand grip 10 relative to the wine bottle 200 results, in upward movement of the cork 201 along the corkscrew 13 and finally disengages from the mouth of the wine bottle 200. Upon noticing the cork 201 has disengaged from the mouth of the wine bottle 200, the user by now can rotate the hand grip 11 in an anti-clockwise direction, which action causes disengagement of the cork 201 entirely from the wine bottle 200 after the hand grip 11 is pulled upward with a little force with respect to the wine bottle 200. Thus, the cork 201 with the corkscrew 13 penetrating therethrough is removed off the wine bottle 200. It is to note that the user only needs to apply a little force and/or torque on the hand grip 11 during the upward removal due to the shoulder 224 in the lower sleeve 22 abutting against the top end of the wine bottle 200.

Figure 7:
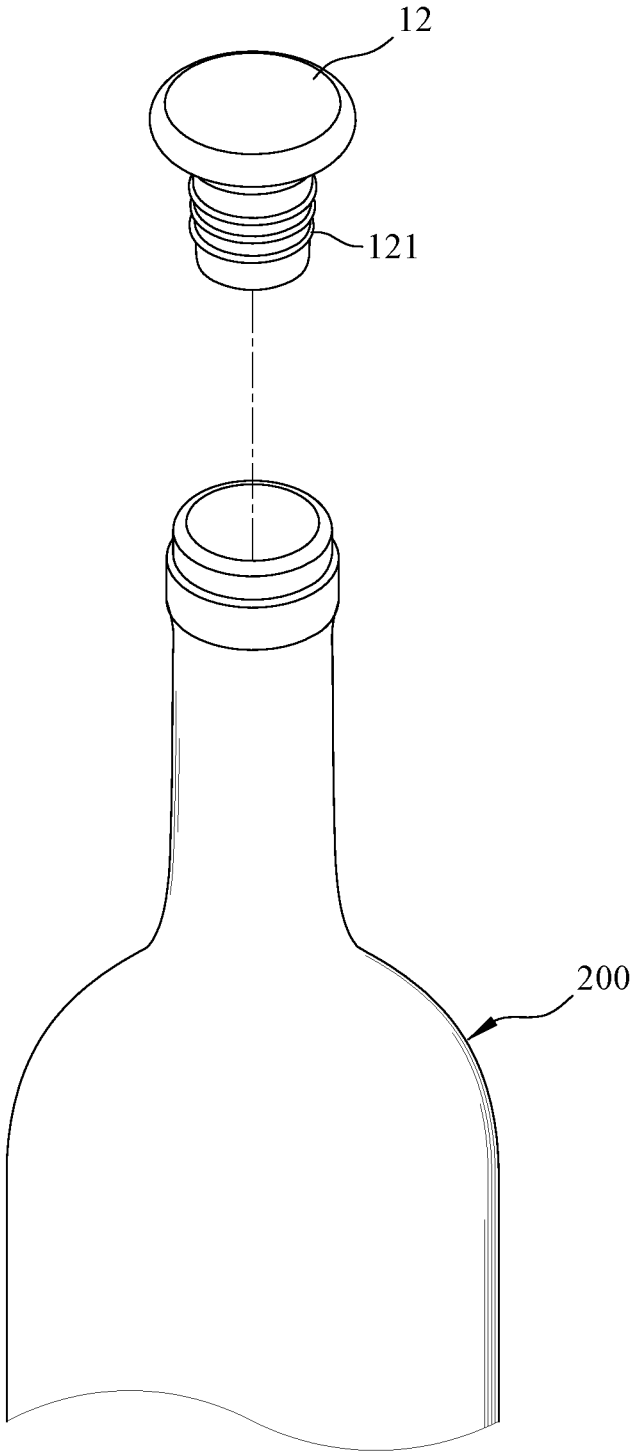
FIG. 7 shows the composite bottle opener of the present invention in application, illustrating a bottle stopper of the composite bottle opener is plugged back into the mouth of a wine bottle.

FIG. 7 shows the composite bottle opener of the present invention in application, illustrating a bottle stopper of the composite opener is plugged back into the mouth of a wine bottle. As shown, after removing the cork 201 off the wine bottle 200, the bottle stopper 12 being independently formed from the hand grip 11 can be plugged back into the mouth of the wine bottle 200 so as to prevent the wine from spilling outward from the wine bottle, simultaneously preventing waste and impurities from getting interior of the wine bottle. Hence, the taste of the wine can be maintained and preserved.

An import an aspect to note is that since the buttons 31 are of the cantilever type such that the cutting tool 32 of the compressible cutter units 30 are spaced apart from the sealing foil encapsulating the outer peripheral portion of the top end of the wine bottle 200 after the lower sleeve 22 the composite bottle opener 100 of the present invention is sleeved around the wine bottle 200. Only when the buttons 31 are pressed inwardly and radially relative the lower sleeve 22 causes in engagement between the cutting tools 32 and the sealing foils, which are generally aluminum foils the most. In other words, the service life of cutting tools 32 of the compressible cutter units 30 can be prolonged.

Another aspect to note is that since the cutting tools 32 are received rotatably in the cantilever buttons 31 in symmetric positions, the cutting tools 32 having an outer peripheral portion formed with a pair of symmetric shearing edges 322 such that during rotation of the cutting tools 32 along a cutting seam, two opposite edges of the sealing foil roll upward and outward along the cutting seam from the outer peripheral portion of the top end of the wine bottle, thereby quickly tearing the sealing foil off the wine bottle. Hence, the shearing edges of the cutting tools need not be sharpened, thereby prolonging the service life of cutting tools 32 of the compressible cutter units 30.

As best shown in FIG. 3, the bottom of the lower sleeve 22 is provided with an outwardly and radially extending annular flange 226, which permits stably sitting of the composite bottle opener 100 of the present invention when the latter is disposed on a table.

Some distinct features of the present invention are as follow:

Since the cork remover unit 10 is mounted on the retractable fixing sleeve 20 and by implementing the compressible cutter units 30 on a side wall of the lower sleeve 22 in such a manner that when in use the compressible cutter units 30 are movable in a thickness direction of the side wall of the lower sleeve 22 upon rotation relative to the wine bottle to tear away the sealing foil off the wine bottle without rotating the latter, thereby minimizing the applied torque.

In addition, due to the bottle stopper 12 of the cork remover unit 10 is independently formed from the hand grip 11, the bottle stopper 12 can be plugged back so as to block the mouth of the wine bottle after removal of the cork of the wine bottle, thereby preventing the wine from spilling to an exterior of the wine bottle and simultaneously preventing waste and impurities from getting interior of the wine bottle and hence preserving the taste of the wine.

Moreover, the cutting tools 32 are received rotatably in the cantilever buttons 31 in symmetric positions, the cutting tools 32 having a pair of symmetric shearing edges 322 such that during rotation of the composite bottle opener 100 of the present invention relative to the wine bottle results in swill tearing of the sealing foil off the wine bottle. Attention is drawn, in order to apply little force and swift tearing away of the sealing foil oil the wine bottle, two compressible cutting units are installed at two symmetric sides the lower sleeve and the cutting units protrude outwardly and radially from the lower sleeve. Under this condition, after pressing the cutler units inwardly and radially relative to the wine bottle, the user needs to rotate the composite bottle opener of the present invention only a half circle reciprocally, which action results in tearing the sealing foil from both sides of the wine bottle. In other words, the sealing foil is torn off from two opposite sides of the wine bottle in a jiffy and/or quickly and one needs to rotate lesser compared with the prior ones.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A composite bottle opener comprising:

a cork remover unit including a hand grip, a bottle stopper and a corkscrew, wherein one end of said corkscrew is connected to said hand grip while said hand grip is attached detachably on said bottle stopper;

a retractable fixing sleeve including a lower sleeve and an upper sleeve mounted movably on said lower sleeve while said cork remover unit is mounted an said upper sleeve; and at least one compressible cutter unit installed on a side wall of said lower sleeve in such a manner that said compressible cutter unit is movable in a thickness direction of said side wall of said lower sleeve.

2. The composite bottle opener according to claim 1, wherein said hand grip and said upper sleeve are integrally formed relative to each other, said hand grip having an upper side dented in such a manner to form a channel while said bottle stopper has a lower portion formed with a plurality of annular engaging ribs for securely engaging a side wall confining said channel in said hand grip.

3. The composite bottle opener according to claim 1, wherein said lower sleeve has a connection portion extending into said upper sleeve and a restriction portion for sleeving over an outer periphery of a top end of a bottle, which is to be opened by the composite bottle opener.

4. The composite bottle opener according to claim 3, wherein each of said upper and lower sleeves is tubular shape such that said connection portion of said lower sleeve has an inner diameter smaller than that of said restriction portion of said lower sleeve, thereby forming a shoulder between said connection portion and said restriction portion for abutting against a top end of a bottle, once the composite bottle opener is disposed on the top end of the bottle.

5. The composite bottle opener according to claim 4, wherein said lower sleeve has a peripheral wall formed with a pair of symmetric holes, in which two of said compressible cutter units are installed such that said compressible cutter units are disposed on said restriction portion of said lower sleeve in a symmetric manner.

6. The composite bottle opener according to claim 5, wherein each of said compressible cutter units includes a cantilever button and a cutting tool, an inner side wall of said restriction portion is formed with a pair of mounting holes for receiving said cantilever buttons respectively while said cutting tools project radially and outwardly from said inner side wall of said restriction portion.

7. The composite bottle opener according to claim 6, wherein each of said cantilever buttons has a tool-reception slot for rotatably receiving a respective one of said cutting tools therein, each of said cutting tools including a tool body having an outer peripheral portion formed with a pair of symmetric shearing edges.

8. The composite bottle opener according to claim 2, wherein said bottle stopper is formed independently from said hand grip and is adapted to be plugged into a mouth of a bottle while said plurality of annular engaging ribs of said bottle stopper are adapted to engage securely an inner side wall confining the mouth of the bottle.

9. The composite bottle opener according to claim 1, wherein said upper sleeve has a peripheral wall formed with a through holes in spatial communication with an interior space thereof while said lower sleeve is fabricated from transparent materials.

10. The composite bottle opener according to claim 3, wherein said connection portion of said lower sleeve has an inner side wall formed with a plurality of angularly spaced and axially extending engaging ribs.

* * * * *